US010254694B2

(12) United States Patent
Miura et al.

(10) Patent No.: US 10,254,694 B2
(45) Date of Patent: Apr. 9, 2019

(54) IMAGE FORMING APPARATUS

(71) Applicant: CANON KABUSHIKI KAISHA, Tokyo (JP)

(72) Inventors: Jun Miura, Kawasaki (JP); Kazuhiro Okubo, Kawasaki (JP); Takahiro Kawamoto, Yokohama (JP); Yuji Kawaguchi, Inagi (JP); Masanori Tanaka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/945,524

(22) Filed: Apr. 4, 2018

(65) Prior Publication Data

US 2018/0299810 A1 Oct. 18, 2018

(30) Foreign Application Priority Data

Apr. 17, 2017 (JP) ..... 2017-081618

(51) Int. Cl.
*G03G 15/02* (2006.01)
*G03G 15/08* (2006.01)
*G03G 15/00* (2006.01)

(52) U.S. Cl.
CPC ..... *G03G 15/50* (2013.01); *G03G 15/0266* (2013.01); *G03G 15/0865* (2013.01); *G03G 15/0877* (2013.01)

(58) Field of Classification Search
CPC ..... G03G 15/0266
USPC ..... 399/55
See application file for complete search history.

(56) References Cited

U.S. PATENT DOCUMENTS

2016/0070203 A1* 3/2016 Kitamura ..... G03G 15/0817 399/103

FOREIGN PATENT DOCUMENTS

| | | | |
|---|---|---|---|
| JP | H08227212 A | | 9/1996 |
| JP | 2002328512 A | * | 11/2002 |
| JP | 2005157124 A | | 6/2005 |
| JP | 4261941 B2 | | 5/2009 |

OTHER PUBLICATIONS

Sunahara. Translation of JP2002328512. Published Nov. 2002. Translated Sep. 2018.*

* cited by examiner

*Primary Examiner* — Walter L Lindsay, Jr.
*Assistant Examiner* — Philip Marcus T Fadul
(74) *Attorney, Agent, or Firm* — Canon U.S.A., Inc. IP Division

(57) ABSTRACT

A control unit of an image forming apparatus controls, in an image forming mode, a potential difference obtained by subtracting the voltage applied to the developer bearing member from the voltage applied to the regulating member so that the potential difference is set to the polarity of the developer, and the control unit controls, in a lubricant discharge mode, the potential difference obtained by subtracting the voltage applied to the developer bearing member from the voltage applied to the regulating member so that the potential difference is set to the polarity of the lubricant or "0".

11 Claims, 7 Drawing Sheets

IMAGE FORMING APPARATUS

BACKGROUND

Field of the Disclosure

The present disclosure relates to an electrophotographic apparatus such as a copier, a printer, or a facsimile.

Description of the Related Art

Every related-art image forming apparatus of an electrophotographic system, such as a copier, a laser beam printer, or a facsimile, is provided with a developing device. The developing device is provided with a roller-shaped developer bearing member that is disposed in such a manner that an opening of a developing container which contains mainly developer (toner) is blocked and a part of the developer bearing member is exposed. The developing device is also provided with a developer regulating member that contacts the surface of the developer bearing member to regulate the amount of developer conveyed by the developer bearing member to a constant amount. When the toner attached to the surface of the developer bearing member passes through the developer regulating member in accordance with the rotation of the developer bearing member, extra toner is removed from the surface of the developer bearing member and returned to the developer container, so that a thin layer of toner is formed on the developer bearing member. A frictional charge (also referred to as triboelectricity) is applied to the thin film of toner formed on the developer bearing member due to the friction between the developer bearing member and the developer regulating member. Japanese Patent Laid-Open No. 2005-157124 discloses a technique in which a potential difference is caused between a developer regulating member and a developer bearing member to thereby enable control of the amount of frictional charge. In a portion where the developer bearing member is exposed from the developer container, toner having a frictional charge is moved onto an electrostatic latent image formed on the surface of the photosensitive member which serves as an image bearing member that rotates in opposition to the developer bearing member.

As such a developing device, a cartridge system that is delivered to each user from a manufacturer in the form of a cartridge is generally employed. For example, when the toner contained in the developing device is depleted and printing cannot be performed, the user purchases a new developing device, which is configured to be detachably attached to an image forming apparatus, and inserts the developing device into the image forming apparatus for use. A new developing device may be shipped in a state where a containing unit that contains toner is sealed with a seal member, from the viewpoint that toner contained in the new developing device to be shipped from a manufacturer is prevented from leaking out of the developing container during transportation.

In the new developing device in which an accommodating portion is sealed, it may take a long time to supply a sufficient amount of toner contained in the containing unit to a surrounding portion of the developer bearing member. Accordingly, when the developing device is rotationally driven, in particular, the frictional resistance between the developer bearing member and the developer regulating member is extremely large. As a result, the developer regulating member may be rolled up, or a gear associated with driving of the developing device may be damaged. Accordingly, Japanese Patent Laid-Open No. H08-227212 proposes a method in which powder coating agent is applied around a developer bearing member at the time of shipment of a new developing device and the developer bearing member is caused to function as lubricant, thereby reducing a rotation torque.

As a material of lubricant applied on the developer bearing member, a material to be charged to a polarity opposite to that of toner when a thin film is formed on the developer bearing member may be used, from the viewpoint of chargeability. In Japanese Patent No. 4261941, the polarity of lubricant applied on the developer bearing member is set to be opposite to the polarity of toner, thereby preventing a reduction in image density in the usage initial stage of the developing device.

However, as discussed in Japanese Patent. Laid-Open No. 2005-157124, the image forming apparatus having a configuration in which, in an image forming mode, the potential difference obtained by subtracting the voltage applied to the developer bearing member from the voltage applied to the regulating member is set to the same polarity as that of developer has a problem. That is, in such a configuration, the use of a lubricant having a polarity opposite to that of toner may cause melt-adhesion of the lubricant to the regulating member, which may have an adverse effect on the image quality.

SUMMARY

According to an aspect of the present disclosure, an image forming apparatus that forms an image on a recording material includes: a developer bearing member configured to bear lubricant and developer; a regulating member configured to regulate a layer thickness of the developer on the developer bearing member; a voltage application unit capable of applying a voltage to the regulating member; and a control unit configured to control the voltage application unit to apply a predetermined voltage to the regulating member, the control unit being capable of executing a lubricant discharge mode for moving the lubricant from the developer bearing member. In the image forming apparatus, the lubricant has charging characteristics that allow the lubricant to be charged to a polarity opposite to the polarity of the developer as a result of being rubbed between the developer bearing member and the regulating member, the control unit controls, in an image forming mode, a potential difference obtained by subtracting a voltage applied to the developer bearing member from the voltage applied to the regulating member so that the potential difference is set to the polarity of the developer, and the control unit controls, in the lubricant discharge mode, the potential difference obtained by subtracting the voltage applied to the developer bearing member from the voltage applied to the regulating member so that the potential difference is set to the polarity of the lubricant or "0".

Further features of the present disclosure will become apparent from the following description of exemplary embodiments (with reference to the attached drawings).

DESCRIPTION OF THE EMBODIMENTS

First Exemplary Embodiment

An image forming apparatus according to an exemplary embodiment of the present disclosure will be described with reference to FIGS. 1 to 4. In the present exemplary embodiment, a method in which a lubricant having a polarity opposite to that of developer is used without causing the lubricant to melt-adhere to the developer regulating member, will be described using a monochrome laser printer as an example of the image forming apparatus.

Dimensions, materials, and shapes of the components and relative arrangements thereof according to the present exemplary embodiment should be appropriately changed in accordance with the configuration and various conditions of the apparatus to which the disclosure is applied. In other words, the following embodiments are not intended to limit the scope of the present disclosure.

<Image Forming Apparatus>

Figure 1:
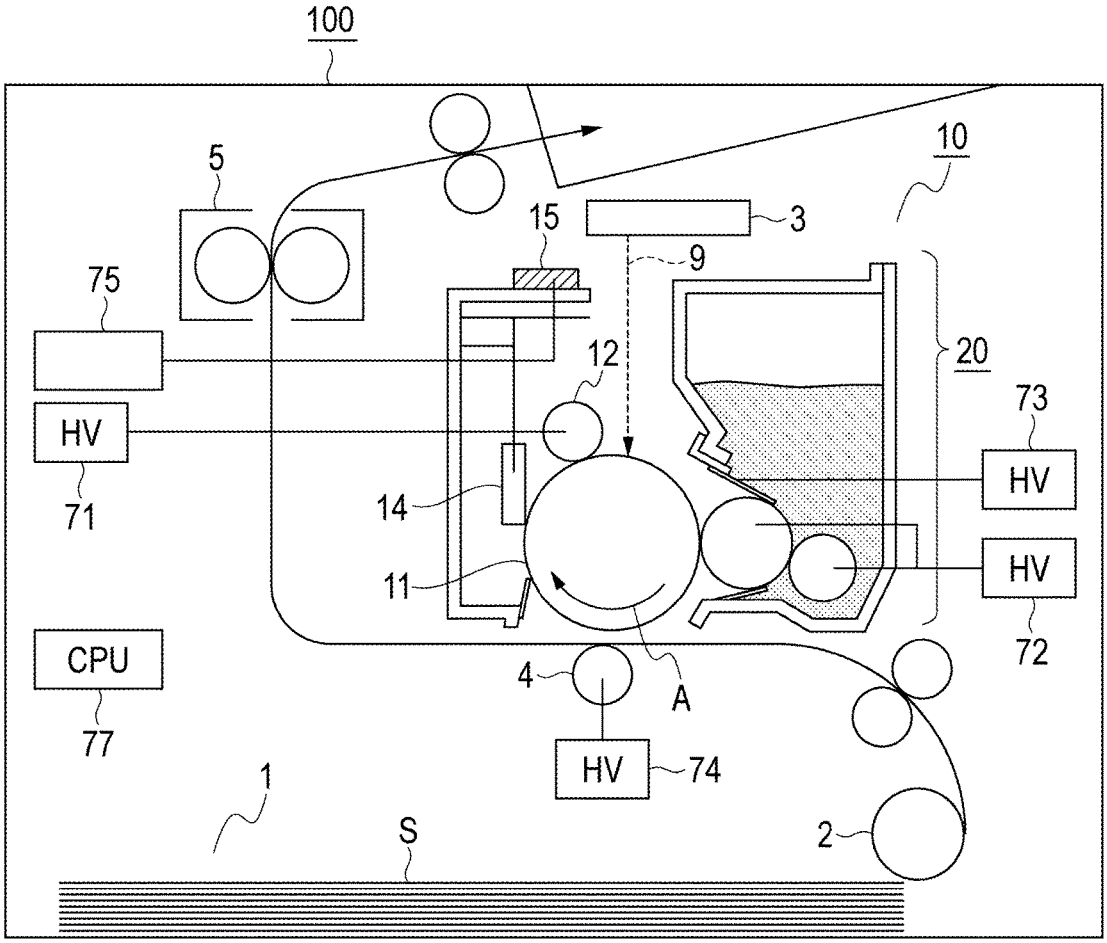
FIG. 1 is a sectional view illustrating an image forming apparatus 100 according to a first exemplary embodiment of the subject disclosure.
Figure 2:
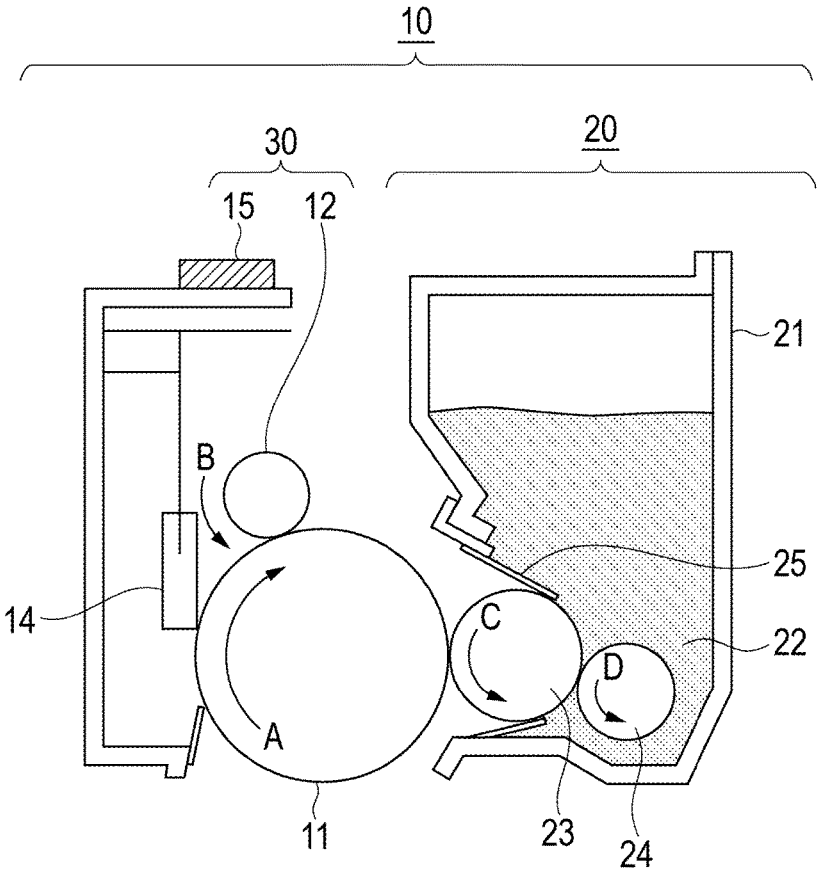
FIG. 2 is a sectional view illustrating a process cartridge 10 according to the first exemplary embodiment of the subject disclosure.

The overall configuration of the image forming apparatus will be described with reference to FIGS. 1 and 2. FIG. 1 is a sectional view illustrating a schematic configuration of the image forming apparatus according to an exemplary embodiment of the present disclosure and illustrating a simplified configuration of each component. FIG. 2 is a schematic sectional view illustrating a process cartridge according to an exemplary embodiment of the present disclosure.

An image forming apparatus 100 according to the present exemplary embodiment includes a process cartridge 10 that is configured to be detachably attached to the main body of the image forming apparatus 100. The process cartridge 10 includes a photosensitive drum 11 (φ20 mm) serving as an image bearing member. Around the photosensitive drum 11, a charging roller 12 serving as a charging member for charging the surface of the photosensitive drum 11, and a developing device 20 that develops an electrostatic latent image formed on the surface of the photosensitive drum 11 with developer are provided. In addition, a cleaning blade 14 serving as a cleaning member for cleaning the surface of the photosensitive drum 11 is provided. The image forming apparatus 100 includes a charging roller power supply 71, a development roller power supply 72, a developer regulating member power supply 73, and a transfer roller power supply 74, each of which serves as a voltage application unit. A voltage can be applied to each of these members.

<Image Forming Process>

Figure 3:
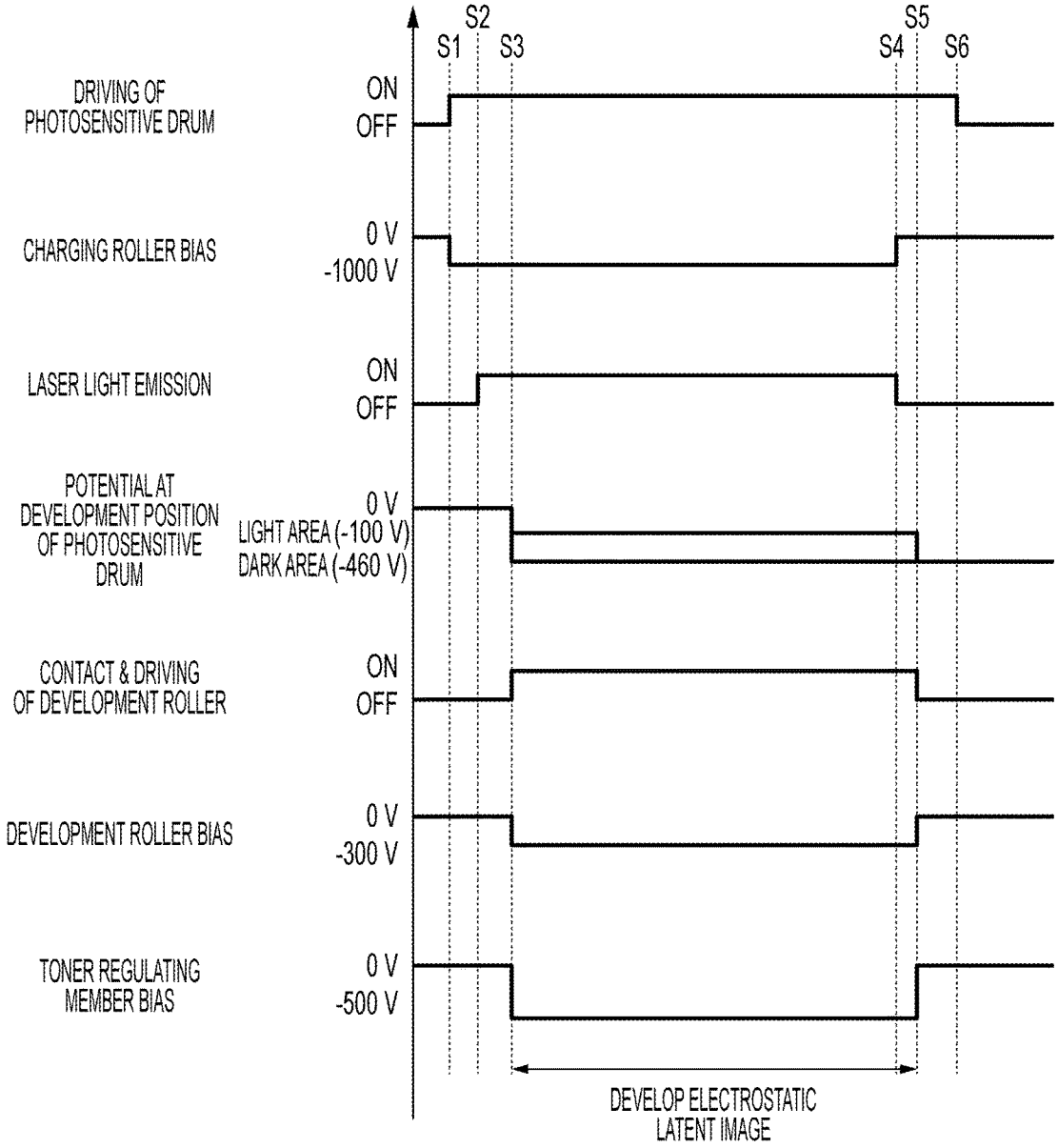
FIG. 3 is a schematic view illustrating an image forming process of the image forming apparatus 100 according to the first exemplary embodiment of the subject disclosure.

Next, an image forming process will be described with reference to FIGS. 2 and 3. When the image forming apparatus receives an image signal from a personal computer or the like, a control unit 77, such as a central processing unit (CPU), executes an image forming mode to start an image forming operation for forming an image on a recording material. The control unit 77 rotates the photosensitive drum 11, serving as the image bearing member, in a direction indicated by an arrow A in FIG. 2 and rotates the charging roller 12, serving as the charging member, in a direction indicated by an arrow B in FIG. 2 in accordance with the rotation of the photosensitive drum 11 serving as the image bearing member. The charging roller power supply 71, serving as a voltage application unit, applies a voltage of −1000 V to the charging roller 12 (S1 in FIG. 3), thereby uniformly charging the surface of the photosensitive drum 11 with a dark-area potential of −460 V. After that, the surface of the photosensitive drum 11 is irradiated with laser light 9 from an exposure device 3, and the potential at a location where the laser light is irradiated is changed to a light-area potential of −100 V, with the result that an electrostatic latent image is formed (S2 in FIG. 3). On the other hand, the developing device 20 is moved in such a manner that a development roller 23, which serves as a developer bearing member and is spaced apart from the photosensitive drum 11, is caused to contact the photosensitive drum 11 by a contacting/separating unit after the rotation of the photosensitive drum 11 is started. Subsequently, the development roller 23, serving as the developer bearing member, starts rotating in a direction indicated by an arrow C in FIG. 2, and a toner supply roller 24, serving as a developer supply member, starts rotating in a direction indicated by an arrow D in FIG. 2. As described below, a voltage of −500 is applied to a developer regulating member 25 including the developing device 20 from the developer regulating member power supply 73, serving as the voltage application unit, when the rotation of the development roller 23, serving as the developer bearing member, is started. Further, a voltage of −300 V is applied to the development roller 23 from the development roller power supply 72 serving as the voltage application unit, and the electrostatic latent image formed on the surface of the photosensitive drum 11 is developed by the developing device 20 (S3 in FIG. 3). The developed developer image is transferred onto a sheet S (paper), which is a recording material, due to a potential difference between the development roller 23 and a transfer roller 4 to which +300 V is applied by the transfer roller power supply 74. The sheet S having the developer image transferred thereto is conveyed to a fixing device 5 and is then heated and pressed. Thus, the developer image is fixed onto the sheet S. After that, the sheet S is discharged to the outside of the image forming apparatus 100. The developer remaining on the photosensitive drum 11 without being transferred onto the sheet S is scraped off by the cleaning blade 14. The process described above is repeated to thereby continuously form images on recording materials. After completion of the image formation, the bias applied to the charging roller 12 from the charging roller power supply 71, serving as the voltage application unit, is turned off and the laser light emission is also turned off (S4 in FIG. 3). Subsequently, the development roller 23 is spaced apart from the photosensitive drum 11, and the bias applied to the developer regulating member 25 from the developer regulating member power supply 73, serving as the voltage application unit, is turned off. Further, the bias applied to the development roller 23 from the development roller power supply 72, serving as the voltage application unit, is turned off (S5 in FIG. 3). The photosensitive drum 11 is driven to allow the surface of the photosensitive drum 11 that is in contact with at least the development roller 23 passes through the cleaning blade 14, and then driving of the photosensitive drum 11 is stopped and the entire image forming process is completed (S6 in FIG. 3). This image process is also referred to as an image forming mode. The control unit 77, such as a CPU, controls the image forming mode to be executable.

<Developing Device>

Next, a configuration of a portion related to a developing process for the developing device according to the present disclosure will be described with reference to FIG. 2.

The developing device 20 includes a developing container 21 having an opening formed at a position opposite to the photosensitive drum 11. The developing container 21 contains toner 22 as developer. The developing device 20 also includes the development roller 23, serving as the developer bearing member, and the toner supply roller 24, serving as the developer supply member. The development roller 23 plays the role of bearing and conveying the toner to the electrostatic latent image formed on the surface of the photosensitive drum 11. The toner supply roller 24 includes a foam layer that rubs the surface of the development roller 23, and plays the role of supplying the toner contained in the developing container 21 to the development roller 23. The developing device 20 also includes the developer regulating member 25 that regulates a layer thickness of the toner 22 supplied to the development roller 23. The developer regulating member 25 has a configuration in which a SUS plate having a thickness of 80 μm is provided integrally with a supporting plate having a thickness of 1 mm and supporting the SUS plate. A leading edge of the SUS plate of the developer regulating member 25 contacts the development roller 23 at a pressure of 25 to 35 g/cm. The direction in which the leading edge of the SUS plate of the developer regulating member 25 contacts the development roller 23 corresponds to a counter direction in which a leading edge of a free end of the SUS plate is located at a downstream side in the rotation direction of the development roller 23 with respect to the contact portion. The material, shape, and contact pressure are not limited to these examples. The toner 22 is non-magnetic one-component polymerized toner, and 1.5 wt % of hydrophobic Si having a particle size of 30 nm are externally added to the surface of the toner as an external additive. The amount of external additive and the material to be externally added are not limited to these examples. The surface of the toner 22 is coated with the external additive, thereby improving the negative charging performance and enabling formation of small gaps in the toner 22, which leads to an improvement in the fluidity of the toner.

During the image formation, as described above, a voltage of −300 V is applied to the development roller 23 from the development roller power supply 72 and a voltage of −500 V is applied to the developer regulating member 25 from the developer regulating member power supply 73. The potential of the developer regulating member 25 with respect to the development roller 23 is set to the negative polarity, thereby improving a charge-providing performance to toner having negative chargeability. As a result, the toner coat on the development roller 23 is stabilized and dripping of drops of toner having a low charge amount and toner scattering (so-called fog) on a white background can be prevented.

Specifically, in the image forming mode, a potential difference obtained by subtracting the voltage (−300 V) applied to the developer bearing member from the voltage (−500 V) applied to the developer regulating member is a negative polarity of −200. This negative polarity is the same as the polarity of the toner used in the present exemplary embodiment. In other words, in the image forming mode, the control unit 77 controls the potential difference obtained by subtracting the voltage (−300 V) applied to the developer bearing member from the voltage (−500 V) applied to the developer regulating member so that the potential difference is set to the polarity of the toner.

<New Developing Device Before Shipment>

Figure 4:
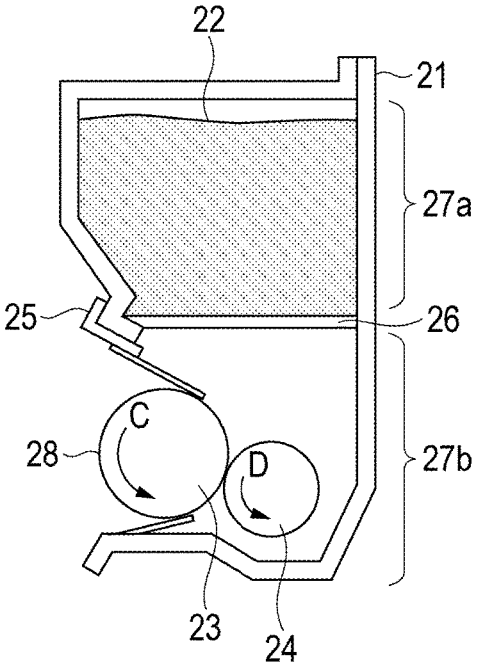
FIG. 4 is a sectional view illustrating a developing device 20 in an unused (new) state according to the first exemplary embodiment of the subject disclosure.

Next, a new developing device will be described with reference to the sectional view of the developing device 20 illustrated in FIG. 4.

The developing device 20 includes a toner storage chamber 27*a* and a developing chamber 27*b* which are in communication with each other. In the factory default state, the toner storage chamber 27*a* and the developing chamber 27*b* are isolated from each other by the seal member 26 that is bonded to the developing container 21, and the toner 22 is present only in the toner storage chamber 27*a*. The seal member 26 is removed before the cartridge 10 is started to use, and the toner storage chamber 27*a* and the developing chamber 27*b* are integrated into a space. The toner 22 reaches the development roller 23, thereby enabling development with the toner 22. The provision of the seal member 26 prevents scattering of the toner 22 from the gap of the opening of the developing chamber 27*b* and contamination of the main body of the image forming apparatus with the toner in a physical distribution process from shipment of the new developing device 20 to the delivery of the developing device 20 to a user. The seal member 26 may be configured such that a user peels off the seal member 26 to expose the opening before use or such that the seal member 26 is automatically peeled off at a timing when the developing device is driven after the image forming apparatus is powered on. In the first exemplary embodiment, the user peels off the seal member 26.

While toner scattering is eliminated by the seal member 26, the toner 22 is not present on the development roller 23 in an unused state. Thus, a frictional force at the contact portion between a developing blade, serving as a developer regulating member, and the development roller increases. Therefore, a large torque is required to initially drive the development roller 23. If the development roller 23 is forcibly driven in this state, there is a possibility that a gear that transmits the driving force may be damaged, as well as that the developing blade may be rolled up in the rotation direction. of the development roller 23 due to the friction between the development roller 23 and the developing blade serving as the developer regulating member 25. To avoid these problems, in the first exemplary embodiment, powder lubricant 28 is preliminarily applied on the new development roller 23. The lubricant 28 is applied on the surface of the development roller 23, thereby reducing a large frictional force between the development roller 23 and the development regulating member without applying the lubricant 28 on the developer regulating member 25.

<Lubricant>

The lubricant 28 used in the present exemplary embodiment will be described in detail below.

The lubricant 28 used in the present exemplary embodiment is desirably used to reduce a driving torque of the development roller 23 when the developing device 20 is started to use. It is also desirable to electrically move the lubricant 28 from the development roller to the photosensitive drum 11 in an initial installation operation described below. Accordingly, in the present exemplary embodiment, the lubricant to be used has a lubrication action and charging characteristics for charging the lubricant to a polarity opposite to that of developer, such as toner, as a result of being rubbed between the development roller and the developing blade.

Other conditions may be appropriately selected depending on the characteristics and the like of the apparatus. For example, materials are preferably selected in consideration of the affinity of lubricant with a contact member, adhesive properties of lubricant on the development roller 23, and chargeability. As for the affinity of the lubricant, the lubricant preferably has no reactivity to any one of members of the development roller 23, the toner supply roller 24, and the developer regulating member 25, even after the lubricant is exposed to a high-temperature high-humidity environment for a long period of time. The adhesive properties of lubricant on the development roller 23 greatly vary depending on the particle size of the lubricant. If the particle size of the lubricant is extremely large, the charge amount per unit volume decreases and an electrostatic adhesive force with respect to the mass of particles decreases, which makes it difficult to coat the development roller 23 with the lubricant. As for the chargeability of the lubricant, it is necessary to hold a certain amount of charge to electrically discharge the lubricant to the photosensitive drum 11. As for the charge polarity, a material having a positive polarity is desirably used to enable only the lubricant 28 to be moved onto the drum separately from the toner 22 and to improve the chargeability of the toner 22 in the usage initial stage of the developing device 20. In other words, the lubricant preferably has a polarity (positive charge polarity) opposite to the polarity (negative charge polarity) of the toner after being rubbed.

In view of the above, in the present exemplary embodiment, Dynamic Beads UCN-5070D Clear (Dainichiseika Color & Chemicals Mfg. Co., Ltd.) which are spherical cross-linked particles made of polyurethane resin were used.

By adjusting the particle size to a mass average particle diameter of 7 μm and adjusting the charge amount to +20 to 50 μC/mg, 30 mg of lubricant is applied on the surface of the new development roller 23. As for the charge amount, the state where the lubricant is applied until the charge is saturated as a result of rubbing the developer regulating member 25 on the development roller 23 is measured. As a charge amount measuring device, a device incorporating a suction unit with a filter to prevent the toner 22 from flowing out of a Faraday cage is used, and the charge amount is calculated by measuring the weight of the sucked toner and the charge amount. The material, shape, charge amount, and coating amount of the lubricant are not limited to these examples and should be appropriately selected depending on the various configurations.

<New Cartridge Detection>

A method for detecting a usage history of the process cartridge 10 will be described with reference to FIG. 1.

The process cartridge 10 according to the present exemplary embodiment includes a storage member 15 capable of storing identification information about the process cartridge 10, usage histories of various members, image process information, and the like. The image forming apparatus 100 also includes a communication unit 75 for sequentially communicating with the storage member 15. Accordingly, it is possible to load data stored in the storage member 15 to change the operation, or to update data or the like on the usage history written into the storage member 15. The image forming apparatus 100 causes the control unit 77 to constantly recognize the latest state of the process cartridge 10 by using the communication unit 75, thereby enabling optimum image formation.

In the present exemplary embodiment, when the process cartridge 10 is inserted into the image forming apparatus 100, data stored in the storage member 15 is loaded by the communication unit 75. The loaded data is sent to the control unit. When the loaded data does not include the usage history (history indicating that the process cartridge 10 operates), the control unit 77 determines that the process cartridge 10 is new.

In the present exemplary embodiment, the communication unit 75 and the control unit 77 are separate members, but instead may be an integrated member.

<Initial Installation Operation>

When the control unit 77 of the image forming apparatus 100 determines that the process cartridge 10 is new, the control unit 77 forms the initial installation operation on the developing device 20 and the cleaning device 3014.

When the process cartridge 10 is new, the development roller 23 of the developing device 20 is not coated with the toner 22. Accordingly, the toner supply roller 24 is impregnated with toner, thereby enabling constant supply of the toner onto the development roller 23. With this configuration, the coat on the development roller 23 can be continuously formed stably.

To reduce the torque of the development roller 23, the lubricant preliminarily applied (borne) is discharged to the photosensitive drum and a lubricant discharge mode (lubricant discharge operation) for collecting the lubricant with a cleaning unit is executed. In the present exemplary embodiment, the operation of moving the lubricant borne on the development roller to the photosensitive drum is referred to as the lubricant discharge mode or lubricant discharge operation.

Next, for the cleaning blade 14 of the cleaning device 30, thermosetting polyurethane rubber is used in terms of chemical resistance, abrasion resistance, formability, and mechanical strength. In the new state where the user starts to use the process cartridge, the cleaning device according to the present exemplary embodiment has no object, such as residual toner, which acts as the lubricant. Thus, a large frictional force is generated at a portion. (contact portion) between the cleaning blade 14 and the photosensitive drum 11, burr, vibration noise, or the like is likely to occur in the cleaning blade 14. Accordingly, in the case of detecting whether the process cartridge 10 is new, the control unit 77 of the image forming apparatus 100 discharges the toner 22 (toner discharge mode) in the initial installation operation, thereby reducing the friction between the cleaning blade 14 and the photosensitive drum 11. Thus, burr, vibration, or the like is prevented from occurring in the cleaning blade 14. In an exemplary embodiment described below, two modes of a lubricant discharge mode and a toner discharge mode are executed in the initial installation operation. However, the modes are not limited to these modes. For example, in the lubricant discharge mode, the lubricant is moved from the development roller to the photosensitive drum, and the lubricant moved onto the photosensitive drum is scraped off by the cleaning blade 14 of the cleaning device 30. The lubricant discharged in the lubricant discharge mode is caused to function as a contact lubricant between the cleaning blade 14 and the photosensitive drum 11, thereby enabling execution of the image forming mode for forming an image on a recording material, without executing the toner discharge mode.

Figure 5:
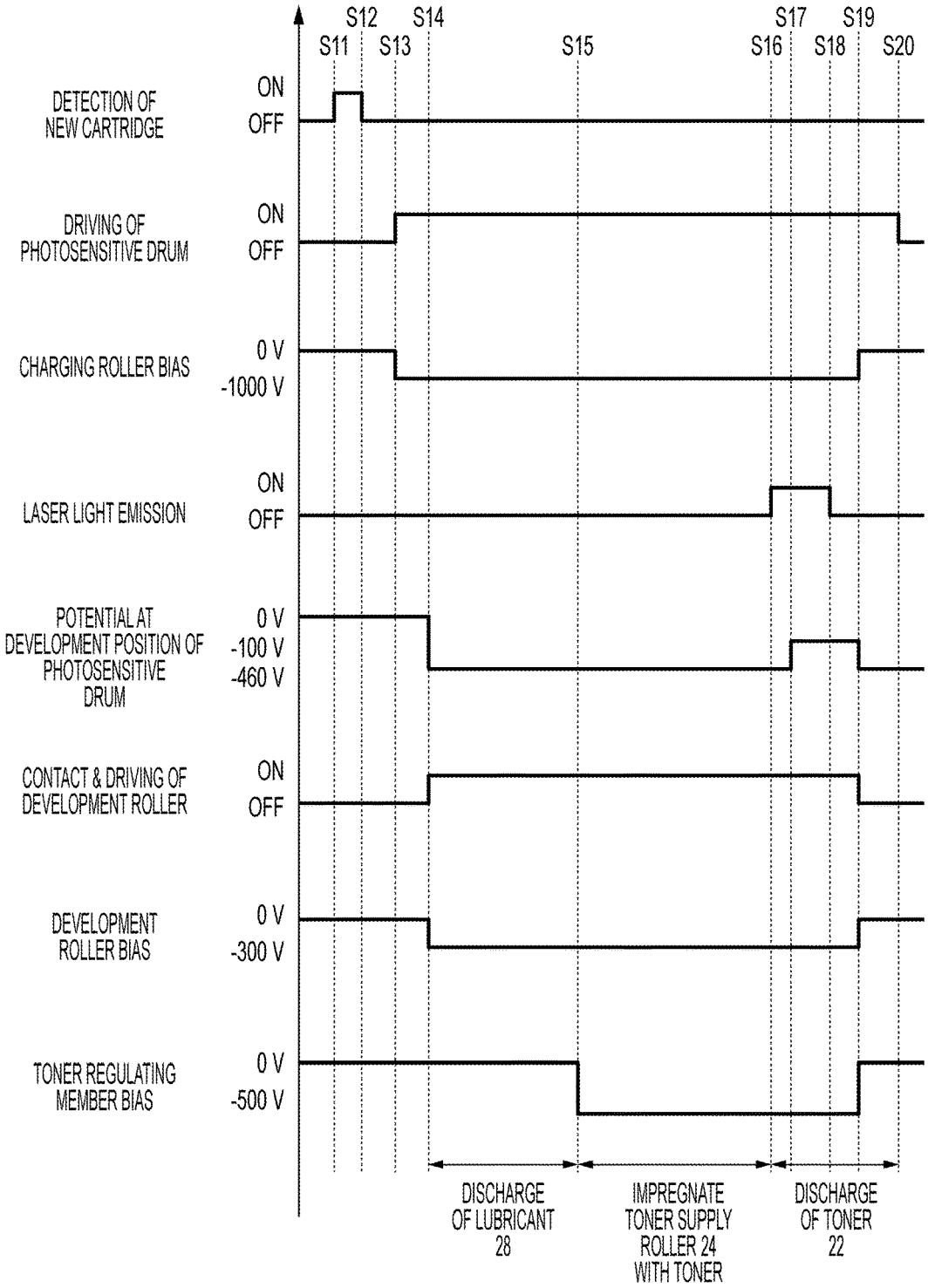
FIG. 5 is a schematic view illustrating an initial installation operation of the image forming apparatus 100 according to the first exemplary embodiment of the subject disclosure.

The initial installation operation according to the present exemplary embodiment will be described in detail below with reference to the timing diagram of FIG. 5.

When the new process cartridge 10 is inserted in a state where the power supply is ON, the new cartridge detection is performed as described above (S11). In the present exemplary embodiment, the control unit loads data stored in the storage member of the process cartridge and determines whether the process cartridge is new to perform the new cartridge detection. After completion of the new cartridge detection (S12), driving of the photosensitive drum 11 is turned on and a voltage of −1000 V is applied to the charging roller 12 to charge the surface of the photosensitive drum 11 to a dark-area potential of −460 V (S13). When the charged surface of the photosensitive drum 11 reaches a development position, driving of the development roller 23 is started to cause the development roller 23 to contact the photosensitive drum 11, and a voltage of −300 V is applied to the development roller 23 (S14). At this time, the developer regulating member 25 is set to 0 V, thereby setting the potential difference to the same polarity as that of the lubricant 28. Specifically, in the lubricant discharge mode, the potential difference (+300 V) obtained by subtracting the voltage (−300 V) applied to the development roller from the voltage (0 V) applied to the developer regulating member is set to the polarity of the lubricant.

In other words, the lubricant 28 receives an. electrostatic force toward the development roller 23 from the developer regulating member 25, thereby preventing melt-adhesion of the lubricant 28 to the developer regulating member 25. At this time, a voltage of −300 V at the normal polarity of the toner is applied to the development roller 23 with respect to a surface potential of −460 V on the photosensitive drum 11, thereby allowing the lubricant 28 that is charged to the positive polarity on the development roller 23 to be moved to the photosensitive drum 11 (lubricant discharge mode). The lubricant 28 moved to the photosensitive drum 11 receives an electrostatic repulsive force from the transfer roller 4 to which a voltage of +300 V is applied from the transfer roller power supply 74, so that the lubricant 28 is finally scraped off by the cleaning blade 14. The series of processes is controlled such that the processes including the control of the voltage can be executed by the control unit 77. The processing of discharging the lubricant 28 in steps S14 and S15 is performed for five seconds, and after the processing of discharging the lubricant 28 is finished, a voltage of −500 V is applied to the developer regulating member 25 (S15). Since the toner 22 is supplied after the lubricant 28 is discharged from the development roller 23, the potential difference of the developer regulating member 25 with respect to the development roller 23 is set to a negative polarity to provide the toner 22 with a sufficient charge, like in the normal image forming operation. That is, the potential difference is set to the same charge polarity as that of the toner. In the present exemplary embodiment, the processing of steps S14 and. S15 is performed for five seconds, the period for the processing is not limited to this example, as long as at least a period shorter than a period in which the lubricant 28 is removed from the development roller 23 is set. For 30 seconds after step S15, the developing device 20 is continuously driven so that the toner supply roller 24 sufficiently contains the toner and the coat on the development roller 23 can be stably formed. Through the processes described above, the developing device 20 can execute the normal image forming operation. Accordingly, in the subsequent process, a control operation similar to the normal image forming operation is performed on the developing device 20.

In step S16 and subsequent steps, the operation of discharging the toner 22 is carried out as the initial installation operation for the cleaning blade 14. From the state of step S15, the laser light emission is turned on in the same manner as in a normal solid black image forming operation (S16), and the surface potential on the photosensitive drum 11 is changed to a light-area potential of −100 V. At a timing when the surface exposed with laser light reaches the development position (S17), the toner 22 on the development roller 23 is developed onto the photosensitive drum 11. The toner 22 on the photosensitive drum 11 passes through the transfer roller 4 to which a voltage of −300 is applied, reaches a nip between the photosensitive drum 11 and the cleaning blade 14 of the cleaning device, and is scraped off, and thus functions as lubricant. In the present exemplary embodiment, the laser light emission is turned off in 0.5 seconds (S18), but the period may be changed depending on the torque relationship between the cleaning blade 14 and the photosensitive drum 11. After that, at a timing when the entire surface exposed with laser light passes through the development position, the development roller 23 is spaced apart from the photosensitive drum 11 and driving of the photosensitive drum 11 is stopped, thereby turning off the voltage applied to the development roller 23, the developer regulating member 25, and the charging roller 12 (S19). Lastly, the photosensitive drum 11 is continuously driven until at least the entire surface of the photosensitive drum 11 that contacts the development roller 23 passes through the cleaning blade 14, and then driving of the photosensitive drum 11 is stopped (S20).

The initial installation operation as described above is performed to thereby enable the lubricant 28 to be sent to the photosensitive drum from the development roller 23 without melt-adhering to the developer regulating member 25, so that the process cartridge 10 can output an excellent image output.

In the present exemplary embodiment, nothing is attached to the cleaning blade 14 in the new cartridge state, the operation of discharging the toner 22 is carried out as a part of the initial installation operation. However, in the new cartridge state, the lubricant can be preliminarily applied on the cleaning blade 14. In this case, the need for discharging the toner 22 is eliminated and the initial installation operation in steps S16 to S18 can be omitted, which leads to a reduction in the initial installation operation.

Second Exemplary Embodiment

Only differences between an image forming apparatus 200 according to a second exemplary embodiment and the image forming apparatus 100 according to the first exemplary embodiment will be described below, and the same members are denoted by the same reference numerals and descriptions of similar parts are omitted.

<High-Pressure Power Supply of Image Forming Apparatus 200>

Figure 6:
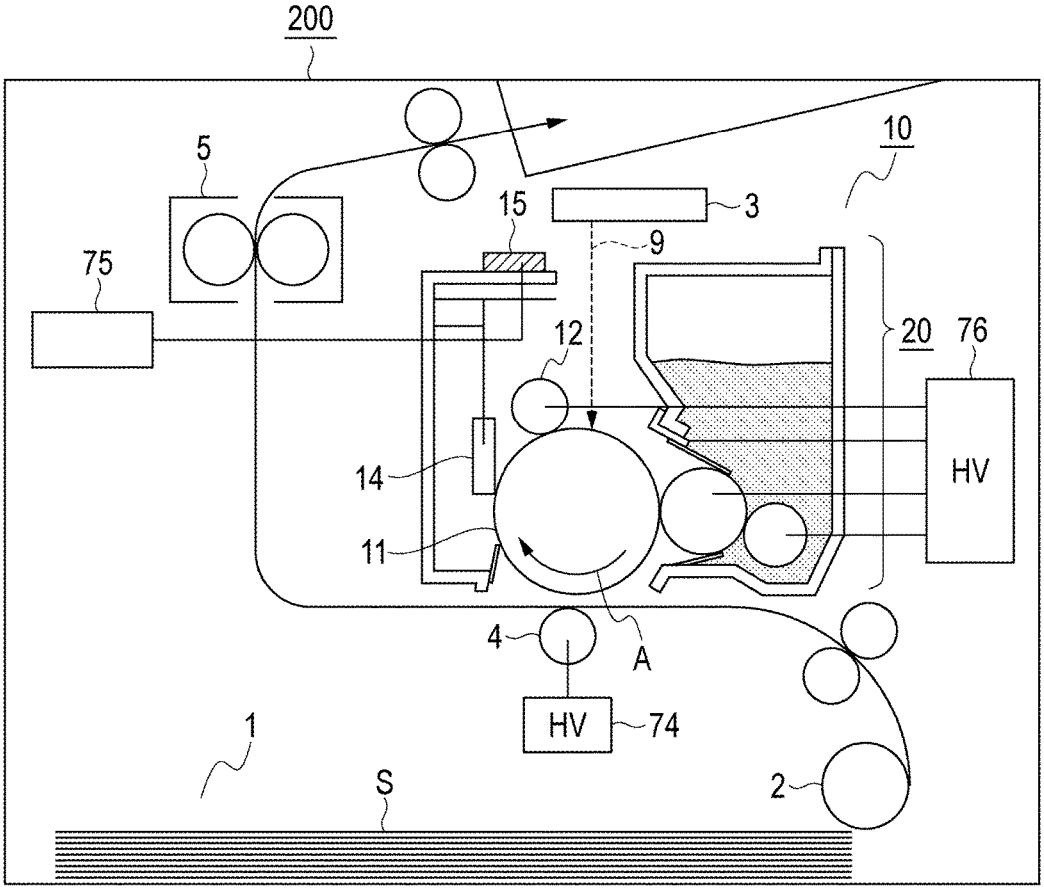
FIG. 6 is a sectional view illustrating an image forming apparatus 200 according to a second exemplary embodiment of the subject disclosure.

The image forming apparatus 200 illustrated in FIG. 6 includes only one common power supply 76 as a high-voltage power supply used for controlling the process cartridge 10, which leads to a reduction in size and cost. Specifically, in the first exemplary embodiment, a first voltage application unit for applying a voltage to the development roller, a second voltage application unit for applying a voltage to the charging roller, and a third application unit for applying a voltage to the toner supply roller are provided. In other words, a first power supply transformer, a second power supply transformer, a third power supply transformer which correspond to the first, second, and third voltage application units, respectively are provided. In the second exemplary embodiment, a common power supply transformer is used as a high-voltage power supply.

Although only one power supply is used, when a voltage of −1000 V is applied to the charging roller 12 by using a Zener diode, a voltage of −500 V is applied to the developer regulating member 25 and a voltage of −300 V is applied to each of the development roller 23 and the toner supply roller 24. Like the image forming apparatus 100 according to the first exemplary embodiment, in the normal image forming operation, the potential of the developer regulating member 25 is set to a negative polarity relative to the development roller 23, thereby improving the charge-providing performance to the toner having negative chargeability. When the common power supply 76 is turned off, the charging roller 12, the developer regulating member 25, the development roller 23, and the toner supply roller 24 are each configured to be set to 0 V. Since the output of a voltage applied to each member is not provided with a switch, when the common power supply 76 is turned on, voltages are simultaneously applied to the charging roller 12, the developer regulating member 25, the development roller 23, and the toner supply roller 24.

<Initial Installation Operation of Image Forming Apparatus 200>

Figure 7:
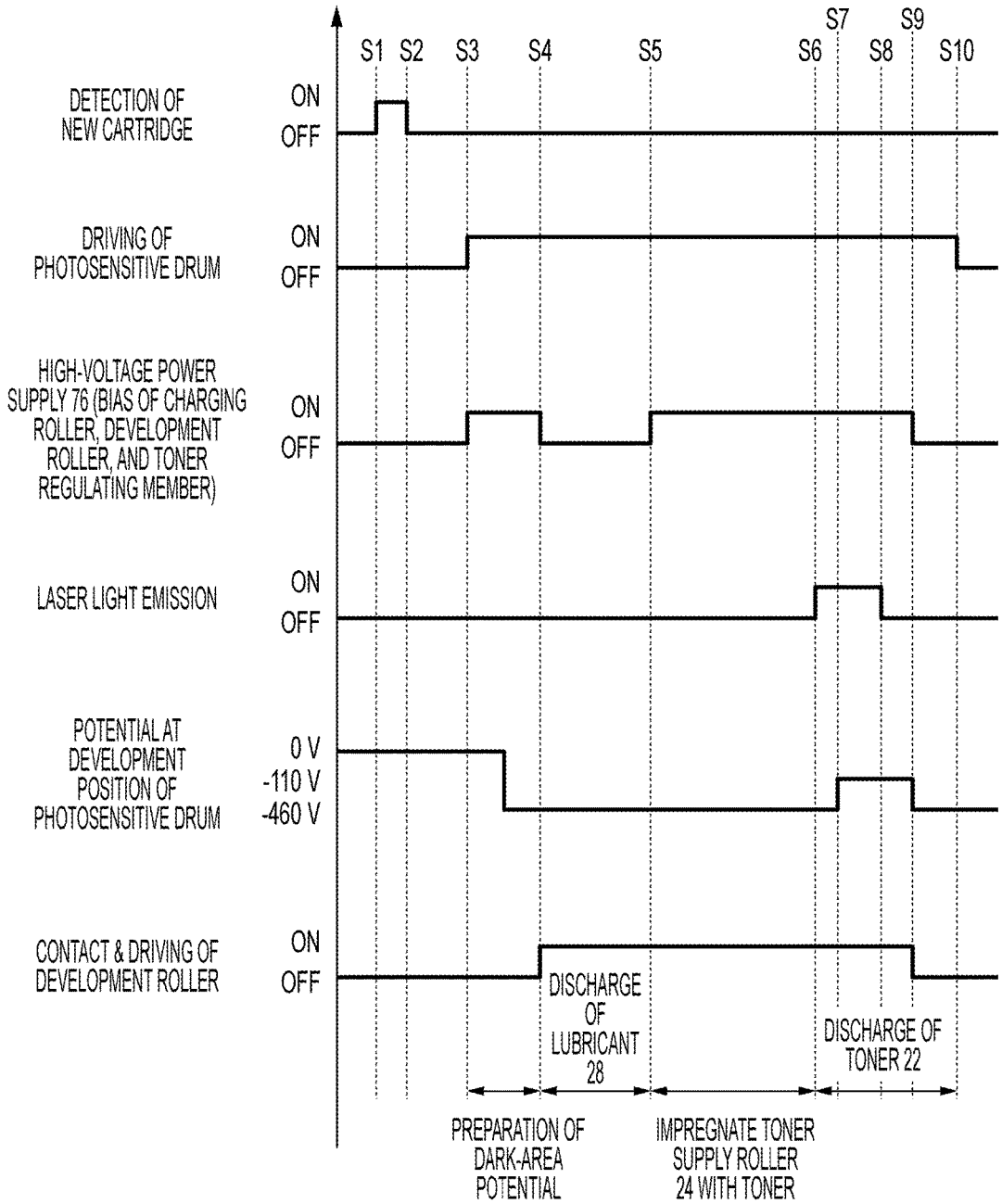
FIG. 7 is a schematic view illustrating an initial installation operation of the image forming apparatus 200 according to the second exemplary embodiment of the subject disclosure.

FIG. 7 is a timing diagram during the initial installation operation in the image forming apparatus 200.

If the new process cartridge 10 is inserted in. the state where the power supply is turned on, the new cartridge detection is performed as described above (S1). After the detection (S2), driving of the photosensitive drum 11 is turned on and the common power supply 76 is also turned on (S3). At this time, various voltages are simultaneously applied to not only to the charging roller 12, but also to the development roller 23 and the developer regulating member 25, from the common power supply. In the new cartridge state where the development roller 23 has never been driven, the lubricant 28 on the development roller 23 is not charged and does not receive an electrostatic force, and thus does not receive a force on the developer regulating member 25 and melt-adhesion does not occur. After the photosensitive drum 11 is rotated at least once in the state of step S3, the common power supply 76 is turned off and driving of the development roller 23 is started to contact the photosensitive drum 11 (S4). The reason why the photosensitive drum 11 is rotated at least once is that the perimeter of the photosensitive drum 11 is charged to a dark-area potential of −460 V (preparation for dark-area potential). The surface potential of −460 V in the dark area of the photosensitive drum is maintained as illustrated, in FIG. 7 even after the common power supply is turned off. The common power supply 76 is turned off at a timing when the development roller 23 is driven so as to prevent melt-adhesion of the lubricant 28 to the developer regulating member 25. In the state where the common power supply 76 is turned off, there is no potential difference between the development roller 23 and the developer regulating member 25, and even when the lubricant 28 is charged to a positive polarity by driving the development roller 23, the lubricant receives no electrostatic force toward the developer regulating member 25 and melt-adhesion does not occur. In the state of step S4, the surface of the hotosensitive drum 11 is charged to −460 V and the development roller 23 is set to 0 V. Accordingly, driving of the development roller 23 allows the lubricant 28 charged to a positive polarity on the development roller 23 to move to the photosensitive drum 11 (lubricant discharge mode). In other words, since the potential of the photosensitive drum 11 is prepared using a dark-area potential, the lubricant 28 can be discharged even in the state where the common power supply 76 is turned off thereafter. After the state of step S4 is continued for five seconds and the lubricant 28 is discharged, the common power supply 76 is turned on (S5) to continuously drive the development roller 23 for 30 seconds. As a result, the toner supply roller 24 sufficiently contains toner and the coat an the development roller 23 can be stably formed. The processes described above enable the developing device 20 to execute the normal image forming operation, and thus, the subsequent process of discharging the toner 22, a control operation similar to the normal image forming operation is performed on the developing device 20.

In the subsequent process of discharging the toner 22, the laser light emission is first turned on like in the normal solid black image forming operation (S6). When the surface exposed with laser light and set to a light-area potential of −100 V reaches the development position (S7), the toner 22 on the development roller 23 is developed onto the photosensitive drum 11. The toner further passes through the transfer roller 4 to which a voltage of −300 V is applied, reaches the nip between the photosensitive drum 11 and the cleaning blade 14, and is scraped off, and thus functions as lubricant. Thus, burr, vibration, or the like can be prevented from occurring in the cleaning blade 14, like in the first exemplary embodiment. After the laser light emission is turned off in 0.5 seconds (S8), at a timing when the surface exposed with laser light passes through the development position, the development roller 23 is spaced apart from the photosensitive drum 11 and driving of the photosensitive drum 11 is stopped, thereby turning off the common power supply 76, the developer regulating member 25, and the charging roller 12 (S9). Lastly, the photosensitive drum 11 is continuously driven until at least the entire surface of the photosensitive drum 11 that contacts the development roller 23 passes through the cleaning blade 14, and then driving of the photosensitive drum 11 is stopped (S10).

The initial installation operation as described above is performed to thereby enable the lubricant 28 to be sent to the cleaning blade 14 from the development roller 23 without causing melt-adhesion of the lubricant 28 to the developer regulating member 25, so that the process cartridge 10 can output an excellent image output.

As described above, the control unit controls, in the lubricant discharge mode, the potential difference obtained by subtracting the voltage applied to the developer bearing member from the voltage applied to the regulating member so that the potential difference is set to the polarity of the lubricant or "0". In the first exemplary embodiment, the potential difference is +300 V and is the same polarity as that of the positive polarity of the lubricant. In the second exemplary embodiment, the potential difference is 0 V.

Further, the control unit controls, in the image forming mode, the potential difference obtained by subtracting the voltage applied to the developer bearing member from the voltage applied to the regulating member so that the potential difference is set to the polarity of the developer. In both of the first exemplary embodiment and the second exemplary embodiment, the potential difference is −200 V and is the same polarity as that of the developer. The potential difference in the image forming mode is preferably in a range from −100 V to −300 V. In the image forming mode, the potential difference obtained by subtracting the voltage applied to the developer bearing member from the voltage applied to the regulating member is set within a range from −100 V to −300 V, thereby facilitating charging with toner.

(Other)

As described above, the lubricant discharge mode controlled by the control unit is a part of the initial installation operation controlled by the control unit. Accordingly, the lubricant discharge mode is executed prior to the image forming mode (or the image forming operation) for forming an image on a recording material. However, the order of the modes is not limited to this. If the lubricant is not sufficiently discharged, the lubricant discharge mode can be executed after the execution of the image forming mode.

In the first exemplary embodiment and the second exemplary embodiment, the developer discharge mode is performed as a part of the initial installation operation. The polarity of a transfer voltage in the developer discharge mode is different from that in the image forming mode, but other voltage control operations are set to the same polarity. Specifically, the voltages applied to the photosensitive drum serving as the image bearing member, the development roller serving as the developer bearing member, the toner supply roller serving as the developer supply member, and the charging roller serving as the charging member are set to the same value.

The image forming mode is controlled by the control unit. In particular, the operation of developing a developer image on a recording material is referred to as the image forming mode. The control unit sends a signal to each power supply to control a predetermined voltage to be applied to each member.

The above exemplary embodiments have been described using negative-polarity non-magnetic one-component toner as developer. Alternatively, toner having a positive polarity as a normal polarity or magnetic toner can be applied depending on the configuration, and two-component developer can also be applied depending on the configuration. The cartridge is not limited to the one in the configuration of the process cartridge described in the exemplary embodiments. For example, a developer container (e.g., a toner cartridge) containing developer, a developing device (e.g., a developing cartridge) including at least a developer bearing member, and the like can also be applied as a configuration that is detachably attached to the image forming apparatus.

In this regard, there is a mode in which the developing device itself includes a frame that accommodates developer, and the developing device itself is replaced after the developer accommodated in the frame is used up. The developing device may have a configuration in which a developer container that accommodates developer is detachably provided separately from the developing device. In this case, the developing device has a configuration in which developer can be supplied from the developer container into the space of the frame that can accommodate developer and supports the developer bearing member.

The main body of the apparatus corresponds to an apparatus constituting portion obtained by excluding at least the detachable configuration from the configuration of the image forming apparatus. For example, when the process cartridge is configured to be detachably attached to the main body of the apparatus, the apparatus constituting portion obtained by excluding the process cartridge from the configuration of the image forming apparatus corresponds to the main body of the apparatus.

According to the disclosure described above, in the configuration in which, in the image forming mode, the potential difference obtained by subtracting the voltage applied to the developer bearing member from the voltage applied to the regulating member is set to the same polarity as that of developer, an excellent image output can be obtained even when a lubricant having a polarity opposite to that of the developer is used.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-081618, filed on Apr. 17, 2017, which is hereby incorporated by reference herein in its entirety.

What is claimed is:

1. An image forming apparatus that forms an image on a recording material, the image forming apparatus comprising:

a developer bearing member configured to bear lubricant and developer;

a regulating member configured to regulate a layer thickness of the developer on the developer bearing member;

a voltage application unit capable of applying a voltage to the regulating member; and a control unit configured to control the voltage application unit to apply a predetermined voltage to the regulating member, the control unit being capable of executing a lubricant discharge mode for moving the lubricant from the developer bearing member, wherein the lubricant has charging characteristics that allow the lubricant to be charged to a polarity opposite to the polarity of the developer as a result of being rubbed between the developer bearing member and the regulating member, the control unit controls, in an image forming mode, a potential difference obtained by subtracting a voltage applied to the developer bearing member from the voltage applied to the regulating member so that the potential difference is set to the polarity of the developer, and the control unit controls, in the lubricant discharge mode, the potential difference obtained by subtracting the voltage applied to the developer bearing member from the voltage applied to the regulating member so that the potential difference is set to the polarity of the lubricant or "0".

2. The image forming apparatus according to claim 1, wherein, in the image forming mode, the potential difference obtained by subtracting the voltage applied to the developer bearing member from the voltage applied to the regulating member is in a range from −100 V to −300 V.

3. The image forming apparatus according to claim 1 wherein the lubricant discharge mode is executed prior to the image forming mode.

4. The image forming apparatus according to claim wherein the control unit controls the voltage application unit to apply a predetermined voltage to the developer bearing member.

5. The image forming apparatus according to claim 1, further comprising a charging member configured to charge a surface of an image bearing member, wherein the control unit controls the voltage application unit to apply a predetermined voltage to the charging member.

6. The image forming apparatus according to claim 1, wherein the control unit is capable of executing, separately from the lubricant discharge mode, a developer discharge mode for moving the developer borne on the developer bearing member.

7. The image forming apparatus according to claim wherein a cartridge including the developer bearing member and a storage member is configured to be detachably attached to the image forming apparatus, and the control unit executes the lubricant discharge mode based on information stored in the storage member.

8. The image forming apparatus according to claim. wherein a cartridge including the developer bearing member and a storage member is configured to be detachably attached to the image forming apparatus, and the control unit determines whether the cartridge is new based on information stored in the storage member.

9. The image forming apparatus according to claim 1, wherein a process cartridge including an image bearing member, developer bearing member configured to develop the image bearing member, and a storage member is configured to be detachably attached to the image forming apparatus, and the control unit determines whether the process cartridge is new based on information stored in the storage member.

10. The image forming apparatus according to claim 1, wherein the voltage application unit is capable of simultaneously applying voltages to the developer bearing member, the regulating member, and the charging member.

11. The image forming apparatus according to claim 1, further comprising an image bearing member, wherein the control unit executes the lubricant discharge mode for moving the lubricant from the developer bearing member to the image bearing member.

* * * * *